United States Patent [19]

Siemund

[11] 3,983,596

[45] Oct. 5, 1976

[54] REVERSIBLE SPONGE RUBBER MOP, BRUSH OR DUSTER

[75] Inventor: Herbert A. Siemund, Chicago, Ill.

[73] Assignee: Greenview Manufacturing Company, Chicago, Ill.

[22] Filed: Mar. 24, 1975

[21] Appl. No.: 561,192

[52] U.S. Cl. ..... 15/244 R; 15/151

[51] Int. Cl.[2] ..... A47L 13/46

[58] Field of Search ..... 15/116 A, 119 A, 121, 15/147 R, 151, 153, 223, 224, 228, 244 R

[56] References Cited

UNITED STATES PATENTS

| | | | |
|---|---|---|---|
| 2,729,840 | 1/1956 | Rogers | 15/244 R X |
| 3,012,265 | 12/1961 | Courtenay | 15/244 R |
| 3,037,229 | 6/1962 | Anderson | 15/119 A |
| 3,076,216 | 2/1963 | Anderson | 15/116 A |
| 3,122,768 | 3/1964 | Beumkes | 15/223 X |
| 3,789,451 | 2/1974 | Laitner | 15/223 |

FOREIGN PATENTS OR APPLICATIONS

| | | | |
|---|---|---|---|
| 943,666 | 11/1948 | France | 15/153 |
| 402,654 | 12/1933 | United Kingdom | 15/147 R |
| 677,866 | 8/1952 | United Kingdom | 15/153 |

*Primary Examiner*—Daniel Blum
*Attorney, Agent, or Firm*—Silverman & Cass, Ltd.

[57] ABSTRACT

A reversible sponge or foam rubber mop, brush or duster which includes a resiliently compressible block or sheet of a synthetic or sponge rubber generally square in configuration with its thickness substantially less than the length of its sides. The compressible block is arranged in a retainer of preferably resilient material which provides a holder for the resilient rubber block, the block being held in a folded condition. The block is frictionally engaged within the retainer by means of a T-shaped member having an elongate handle in the form of a mopstick passing through an opening in the block and an aligned opening in the retainer, the retainer having a flared entrance and an expanded interior so that the elongate handle of the T-shaped member may be inserted into the block, threaded through the opening in the retainer and the block pulled into the retainer by means of the handle pulling on the crossbar of the T, being held frictionally within the retainer during use. The block is reversible to enable multiple edge use. A hollow ferrule on the retainer has its axial passageway aligned with the retainer opening to receive the handle and stabilize same during use.

8 Claims, 5 Drawing Figures

REVERSIBLE SPONGE RUBBER MOP, BRUSH OR DUSTER

CROSS REFERENCE TO RELATED U.S. APPLICATION

This application is a an improvement of my U.S. Pat. application Ser. No. 406,847 filed Oct. 16, 1973 having the same title as this application.

BACKGROUND OF THE INVENTION

The copending application Ser. No. 406,847 is incorporated herein by reference for the purpose of the background of the invention, the field of this invention, and the description of the prior art.

The invention herein differs from the invention of the copending application in that the retainer is constructed differently especially in having a flared entrance and an expanded interior and the mop handle of this invention has a permanently secured crossbar which forms a T configuration, the shaft of the handle itself being slidable relative to the retainer through a passageway in the center of the retainer. A tubular ferrule integral with the retainer and having an axial passageway aligned with that of the retainer provides stabilization for the mop handle.

The mop of the invention is assembled by the user in one stroke and held in assembly without manipulation of the mop handle after effecting such stroke.

The same advantages of reversal of the block of sponge rubber are inherent of the mop of the invention.

A pertinent reference is U.K. Pat. No. 677,866.

SUMMARY OF THE INVENTION

A reversible sponge-like mop device provided with a retainer having wings and formed of a resilient material, being provided with a flared entrance and an expanded interior wider than the entrance. A mop handle has a crossbar at one end thereof providing a T-shaped formation. A block or sheet of sponge-like resilient material such as sponge or foam rubber is generally square in configuration and has a central opening.

The mop is assembled by engaging the mop handle through the opening in the sponge-like member and bringing the crossbar into engagement with the member to fold it around the crossbar. The mop handle is passed through a central passageway formed in the retainer from the inside of the retainer and when the block of sponge-like material is pulled against the entrance to the retainer it is compressed by the flared entrance which serves as a pilot and is pulled into the interior of the retainer by the crossbar expanding as it reaches the interior and the crossbar bears against the top inner wall of the retainer. In this condition friction keeps the mop in assembly.

A ferrule is provided for manipulation of the retainer and the retainer is provided with air passageways to keep the sponge-like member fresh and enable it readily to dry after use. The ferrule also stabilizes the mop handle.

DESCRIPTION OF THE PREFERRED EMBODIMENT

Figure 1:
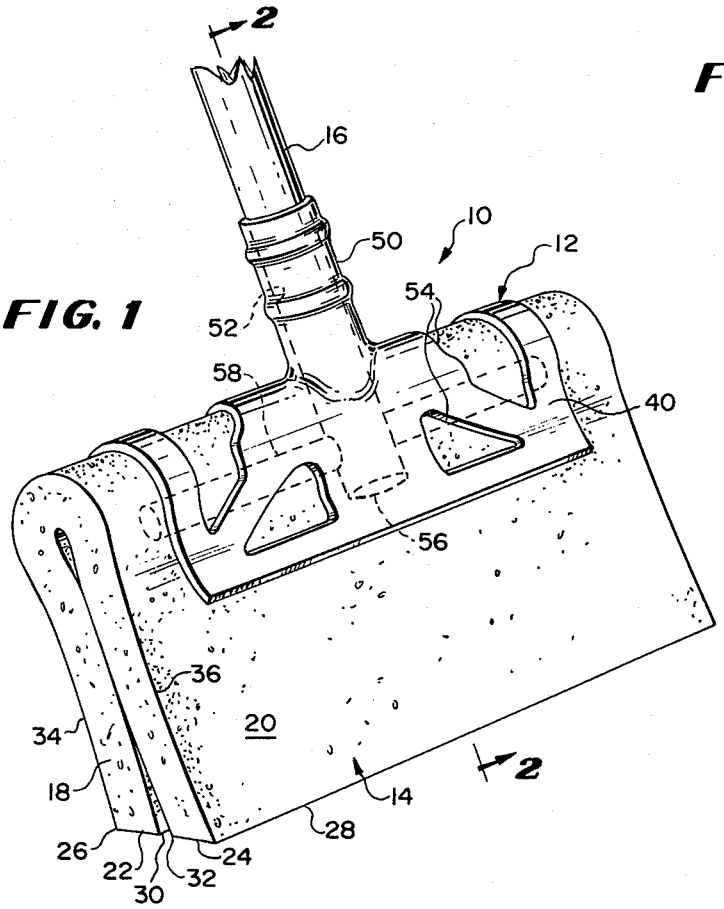
FIG. 1 is a perspective view showing the mop of the invention fully assembled.

Generally, the purposes and functions of the mop of the invention herein are explained in detail in the application incorporated herein by reference. As mentioned above there are differences between the mop of the instant invention and that of the copending application on the basis of which the mop of the invention is more efficient, easier to use, easier to assemble and more economical to manufacture.

Reference character 10 designates the mop of the invention and the same is comprised of three parts, a retainer 12, the sponge-like member 14 and the mop handle 16.

The sponge-like member 14 is similar to that of the copending application incorporated by reference and when folded as will be obvious, has two halves 18 and 20 and the bottom ends 22 and 24 with the cleaning edges 26 and 28. As explained in the copending application after use the mop may be disassembled, the sponge-like member 14 reversed, and the edges 30 and 32 are available thereafter as new sweeping or cleaning edges. Again, after such use the mop may be disassembled, the member 14 rotated through 90° and new edges 34 and 36 are disposed on the bottom of the mop and available as cleaning edges with one more reversal being possible.

The problems with the mop disclosed in the copending application were first that it was difficult to assemble the folded sponge-like member 14 into the wire cage of said mop of the copending application and second it was necessary to screw and unscrew the mop handle from the wire member and its stud in order to assemble and disassemble the mop. Furthermore, the prior mop in its preferred embodiment had three loose parts to be manipulated while the alternate embodiment had a requirement that the mop handle have a large end portion in place of a clamping plate which is unsatisfactory because it pierces through the sponge-like member.

Other disadvantages relate to the expense of constructing the retainer edge.

Figure 2:
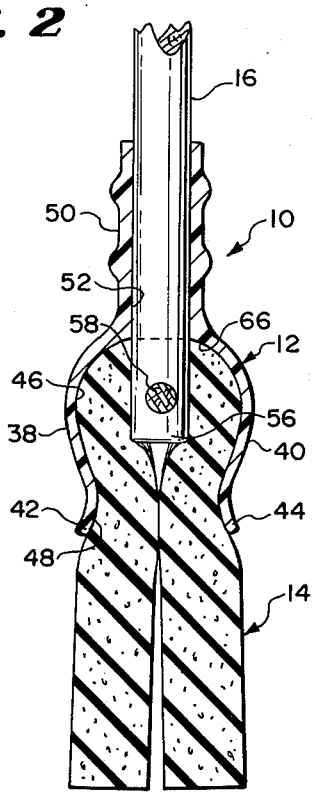
FIG. 2 is a sectional view taken generally through the center of the mop along the line 2—2 and in the direction indicated.

In the mop of the invention herein the retaining member 12 has a U-shaped cross-sectional configuration providing the wings 38 and 40. Assuming that the normal position of the mop 10 is as shown in FIG. 2, the bottom edges of the wings have the lips 42 and 44 which are narrower than the interior of the retainer at its upper end and in addition flare outwardly. In accordance with this construction there is an expanded interior in the retainer at 46 and a narrow entrance at 48 so that when the sponge-like block 14 is folded and pushed or pulled into the retainer 12 its folded part will have to be constricted before it can enter into the retainer 12.

With respect to dimensions, they are capable of wide variation but obviously it is required that the dimension between the lips 42 and 44 at the entrance 48 where it is the narrowest, must be substantially less than the double thickness of the folded block or sheet of sponge-like material 14.

The retainer 12 preferably has a hollow ferrule or bushing 50 integral therewith to enable the retainer member 12 to be manipulated and to stabilize the mop handle 16 during use. There is a central passageway 52 in the retainer that is a continuation of a central passageway axially provided in the ferrule 50 through which the mop handle slidably engages.

The retainer preferably is molded from synthetic resins such as methacrylates, nylon and the like. On this account it is inert and will not rust or be affected by water or cleaning detergents, while being resilient to some extent. Furthermore, it is easily molded at very low cost. The lips 42 and 44 may be quite smooth so that the sponge rubber-like material of the block 14 will readily slide relative to such lips in assembling and disassembling the mop 10. Most plastics have very smooth surfaces to promote sliding.

In order to ventilate the block or sheet of sponge-like material to prevent rotting and to enable it quickly to dry, ventilating openings 54 are formed in the retainer 12 in such a manner as to provide the ventilation without decreasing the ability of the retainer to hold the block 14 in its folded condition.

The upper end of the mopstick 16 is conventional and is readily slidable with respect to the passageway 52. The lower end of the mop stick 16 has a special construction. This lower end 56 has a crossbar 58 of wood or the like permanently engaged therein so that the mopstick is in effect a T-shaped member. It will be recalled that in the mop of the copending application the wire cage included a transverse wire member which had to be assembled to and disassembled from the mopstick in order to assemble or disassemble the mop.

According to the invention herein with the crossbar 58 a permanent part of the mopstick 16 assembly and disassembly is a very simple matter.

Figure 3:
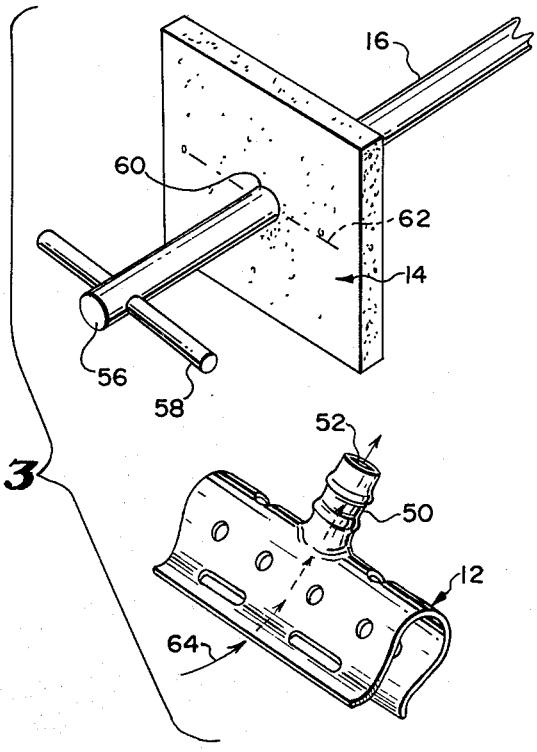
FIG. 3 is an exploded view showing the disassembled parts of the mop of the invention, the ventilating openings being somewhat different from those of FIG. 1.

Looking first at FIG. 3, illustrated there are the mopstick 16 with the crossbar 58 permanently secured to the end 56 of the mopstick. The square or block of sponge-like material 14 is shown apart from the retainer 12. There is a central opening 60 in the block 14 exactly as in the mop of the copending application. The user inserts the upper end of the mopstick 16 through the opening 60 and pulls up the corssbar 58 until it is located exactly across the center of the block 14 which is explained in the copending application. The mopstick thus serves as a pulling handle. In use the crossbar will be engaged to that portion of the block 14 shown as a broken line 62 in FIG. 3. Preferably, the crossbar 58 is somewhat shorter than the full width of the block 14.

Figure 4:
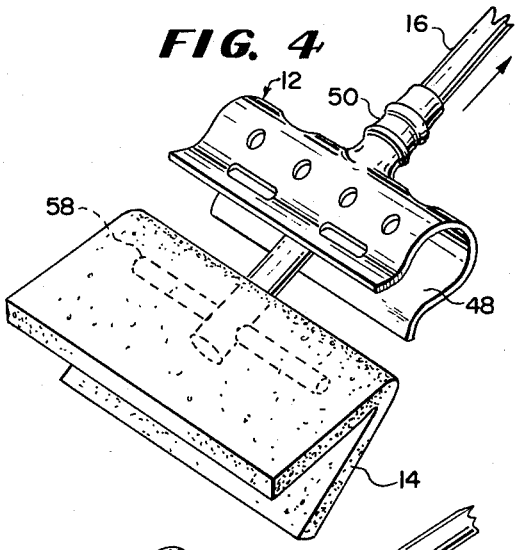
FIG. 4 is a perspective view showing generally the parts of the mop in process of being assembled.

At this point the upper end of the mopstick 16 is now engaged into the retainer 12 from the bottom thereof in a maneuver generally indicated by the arrow 64 in FIG. 3. The mopstick 16 slides through the passageway 52 until the block 14 with the crossbar 58 are brought to the entrance 48 as shown in FIG. 4. To assist the movement of the block 14 into the retainer 12 the user may pre-fold the block as shown but since this folding will be to a great extent accomplished when the user pulls the mopstick through the passageway 52 such pre-folding is not necessary. FIG. 4 shows the mopstick and the folded block 14 just prior to entering the retainer 12.

Figure 5:
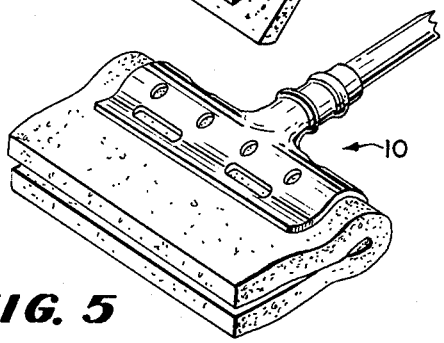
FIG. 5 is a perspective view of the assembled mop of FIGS. 3 and 4.

The next step of assembly is simply to pull the mopstick 16 as far into the retainer as will be permitted by the crossbar 58 and when this has been accomplished the mop will have the appearance of FIG. 5.

In the course of pulling the folded block 14 into the retainer 12 first the lips 42 and 44 will spread slightly if the wings are resilient. Preferably the retainer is resilient although it may be stiff and nonresilient. In any event, their flared configuration will pilot the folded end which has been half-way wrapped around the crossbar 58 into the retainer.

As the crossbar is further pulled into the retainer by the mopstick 16 the following portions of the folded block 14 enter past the entrance 48 to the interior of the retainer 12 and expand at 46. Having pulled the mopstick 16 tightly up against the bottom 66 of the retainer with the fold sandwiched between the crossbar 58 and said bottom 66 a substantial part of the folded block 14 is within the retainer. Since removal of the block 14 requires compression of the expanded portion within the retainer there is in effect, therefore, a firm frictional engagement of the block 14 within the retainer 12.

Although not essential, the fit of the mopstick 16 within the passageway 52 may be fairly close so that there is somewhat of a frictional resistance to the mopstick 16 moving within the passageway 52.

The mop 10 may now be used readily without concern of it being inadvertently disassembled.

For actual disassembly the reverse process is followed, it being a simple matter to push the mopstick 16 back through the passageway 52 and thereafter to remove the block 14. As a matter of fact by simply moving crossbar 58 beyond the extent of the lips 42 the block 14 can be refolded in the opposite direction and turned and reinserted into the retainer to give the user new cleaning edges.

Variations can be made without departing from the spirit or scope of the invention as defined in the appended claims.

What is desired to secure by Letters Patent of the United States is:

1. A reversible sponge-like mop device comprising:

A. a resilient, compressible, substantially square sheet of spong-like material whose thickness is substantially less than the length of an edge of said square, folded in half to provide cleaning edges opposite the fold and having a first central passageway therein, B. a retainer for engagement over the folded sheet in a clamping action with the fold and a substantial part of the sheet installed on the interior of said retainer with the cleaning edges extending freely outside of and beyond the entrance to the retainer, said retainer being of U-shaped cross section and extending along the length of the fold and providing a pair of wings terminating in a blind bottom, the wings being flared outwardly at the entrance and narrowed at a location slightly inwardly of the entrance to a dimension at most about the same as the double thickness of the sheet at that location, said retainer having an expanded portion between said location and its bottom, said retainer having a second central passageway through the bottom which is generally perpendicular to its length and aligned with the first passageway when the sheet is installed in folded condition, C. a mopstick having an integral crossbar at one end thereof opposite the handle and the mopstick being engaged through both passageways and pulled up by the handle seating the folded sheet with the crossbar contained in the fold in the inner portion to clamp the folded sheet in the retainer with the cleaning edges extending as aforesaid, and D. the thickness of the combined crossbar and sheet at the fold when assembled together with the mopstick extending through the first passageway being such that when the mopstick is threaded through the second passageway from the interior of the retainer while carrying the sheet and moved along its length to draw the sheet toward the entrance, the crossbar and folded sheet will first move into the entrance and then meet substantial resistance in passing the narrowed location and thereafter will easily pass into the expanded inner portion and be clamped and retained thereat to keep the mopstick, folded sheet and retainer in assembly for ready use without fastening means, but the folded sheet and crossbar being readily capable of movement in a reverse direction by manual sliding movement of the mopstick to move said sheet and crossbar out of clamped position in the retainer to enable reversal or replacement of the sheet.

2. A device as claimed in claim 1 in which the length of the retainer is somewhat less than the length of the fold.

3. A device as claimed in claim 1 in which the retainer is stiff and not resilient.

4. A device as claimed in claim 1 including a hollow ferrule secured on the retainer, the passageway in the retainer being a continuation of the central passageway in the ferrule, the mopstick being engaged through the ferrule.

5. A device as claimed in claim 4 in which the mopstick is frictionally engaged in the ferrule but is capable of being slid relative thereto by overcoming the frictional engagement.

6. A device as claimed in claim 1 in which the retainer has ventilating openings provided therein.

7. A device as claimed in claim 1 in which the length of the crossbar is shorter than the full width of the block.

8. A device as claimed in claim 7 in which the length of the retainer is somewhat less than the length of the fold.

* * * * *